US009384714B2

(12) United States Patent
Takeda

(10) Patent No.: US 9,384,714 B2
(45) Date of Patent: Jul. 5, 2016

(54) DISPLAY DEVICE

(71) Applicant: Japan Display Inc., Tokyo (JP)

(72) Inventor: Nobuhiro Takeda, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 0 days.

(21) Appl. No.: 14/458,323

(22) Filed: Aug. 13, 2014

(65) Prior Publication Data

US 2015/0054814 A1 Feb. 26, 2015

(30) Foreign Application Priority Data

Aug. 22, 2013 (JP) ..... 2013-172094

(51) Int. Cl.
*G09G 5/395* (2006.01)
*G09G 3/32* (2016.01)

(52) U.S. Cl.
CPC ..... *G09G 5/395* (2013.01); *G09G 3/3208* (2013.01); *G09G 2310/04* (2013.01); *G09G 2320/046* (2013.01); *G09G 2330/021* (2013.01)

(58) Field of Classification Search
CPC ..... G09G 2320/046; G09G 2330/021; G09G 2320/0257; G09G 2320/043
USPC ..... 345/76
See application file for complete search history.

(56) References Cited

U.S. PATENT DOCUMENTS 7,196,700 B1 * 3/2007 Aho ..... G09G 3/20 345/211
2002/0044143 A1 * 4/2002 Kota ..... G09G 3/3216 345/204
2002/0186191 A1 * 12/2002 Ikeda ..... G09G 3/3648 345/87
2004/0222951 A1 * 11/2004 Lee ..... G09G 3/3208 345/77
2005/0083324 A1 * 4/2005 Ueda ..... G09G 3/04 345/211
2005/0093850 A1 * 5/2005 Mori ..... G09G 3/007 345/204
2007/0109284 A1 * 5/2007 Yamazaki ..... G09G 3/20 345/204
2012/0236040 A1 * 9/2012 Eom ..... G09G 3/007 345/681

FOREIGN PATENT DOCUMENTS

JP 2006-211044 A 8/2006

* cited by examiner

*Primary Examiner* — Koosha Sharifi-Tafreshi
(74) *Attorney, Agent, or Firm* — Typha IP LLC

(57) ABSTRACT

The subject of the present invention is preventing the generation of screen burn-in in the case of low power consumption driving. A display panel of the present invention includes an image line for inputting an image voltage to each pixel, and a drive circuit, the drive circuit includes an internal control signal generation circuit for generating a control circuit, a memory for storing image data of a fixed display pattern in the case of the low power consumption drive mode, an image voltage output means for converting image data read from the memory to an image voltage and supplying the image voltage to the image line, and a means for changing a read timing of image data read from the memory, wherein the read timing of image data and a display position of the fixed display pattern to be displayed on the display panel is changed for each frame.

6 Claims, 4 Drawing Sheets

DISPLAY DEVICE

CROSS-REFERENCE TO RELATED APPLICATIONS

This application is based upon and claims the benefit of priority from the prior Japanese Patent Application No. 2013-172094, filed on 22 Aug. 2013, the entire contents of which are incorporated herein by reference.

FIELD

The present invention is related to a display device. In particular the present invention is related to a technology effective for low consumption power driving.

BACKGROUND

In recent years, the demand for flat panel display (FPD) devices has been increasing. In particular, organic EL display devices which use an organic EL (Electro Luminescence) element (OLED; Organic Light Emitting Diode) are excellent in terms of power consumption, lightness, thinness, video properties and viewing angle, and the development and practical use of such devices is progressing. Since the high definition of organic display panels in organic EL display devices used in smartphones is progressing, the increase in power consumption that accompanies this trend is becoming a problem. However, a high definition display is not necessary in various situations and It is sometimes sufficient to display only basic data such as time and date, the state of the device (signal strength, remaining battery), or communication data (call history, mail inbox). However, sub-screens such as those mounted in conventional mobile phones are not mounted in organic EL displays, in smartphones, it is necessary to operate a large screen organic EL display panel even when displaying a small amount of data. And, that leads to an increase in power consumption.

While partial driving for reducing power consumption has been proposed in liquid crystal display devices for mobile phones, the power consumption of illumination devices which act as a light source in liquid crystal devices is overwhelmingly large and power reduction effects are few. When partial driving is applied to a display device in which power consumption increases according to display gradation and the number of display pixels as in organic EL display panels, the reduction effects of power consumption are considerable. However, in organic EL display panels, when partial display is performed using partial driving, organic EL elements which are continuously displayed deteriorate and screen burn-in occurs. In order to avoid these problems, when an image is input as a usual operation from the host side in order to change the position of the image, there is a problem that power consumption on the host side increases. Furthermore, although "a method for preventing screen burn-in by performing display in a different position to a previous display position stored in advance at the time of initializing power" has been proposed in Patent Document 1 (Japanese Laid Open Patent 2006-211044), the prevention effects of screen burn-in are limited since the power initialization cycle cannot be controlled.

SUMMARY

According to an embodiment of the present invention, a display device includes a driving circuit operated in a normal drive mode and a low power consumption drive mode, the driving circuit configured to display a fixed display pattern on a display panel in the case of the low power consumption drive mode, wherein a display position of the fixed display pattern to be displayed on the display panel is changed for each frame in the case of the low power consumption drive mode.

According to an embodiment of the present invention, a display device includes a driving circuit operated in a normal drive mode and a low power consumption drive mode, the driving circuit configured to display a fixed display pattern on a display panel in the case of the low power consumption drive mode, the display panel including an image line configured to input an image voltage for each pixel, wherein the driving circuit includes an internal control signal generation circuit configured to generate a control signal in the case of the low power consumption drive mode, a memory configured to store image data of the fixed display pattern to be displayed on the display panel in the case of the low power consumption drive mode, an image signal output circuit configured to convert image data read from the memory to an image voltage and supply the image voltage to the image line, and a display control circuit configured to change a read timing of the image data read from the memory, wherein a read timing of the image data read from the memory and a display position of the fixed display pattern to be displayed on the display panel are changed for each frame in the case of the low power consumption drive mode.

The display position of the fixed display pattern may be changed in a certain sequence or randomly for each of the frames.

DESCRIPTION OF EMBODIMENTS

Figure 1:
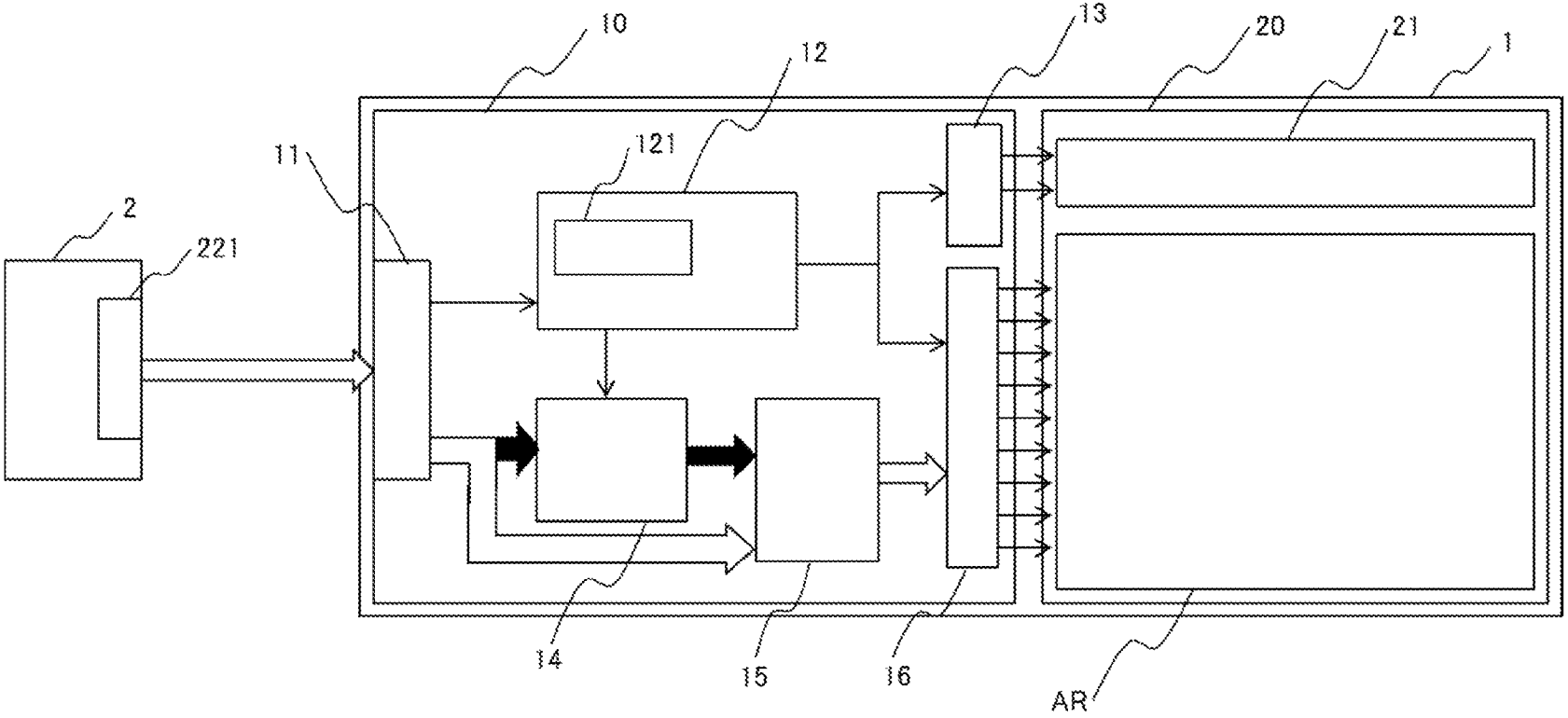
FIG. 1 is a block diagram showing a schematic internal structure of an organic EL display device of an embodiment of the present invention.

The present invention was performed in order to solve the problems of the conventional technology and aims to provide a technology capable of preventing the occurrence of screen burn-in in the case of driving at low power consumption of images containing a small amount of data. The aim of the present invention, other aims and new characteristics will be clarified using the descriptions in the present specification and the attached drawings.

The embodiments of the present invention are explained below with reference to the drawings. In all the drawings for explaining the embodiments, parts having identical functions are given the same reference numerals, and description thereof is not repeated. Further, the embodiments described below are merely an example of an embodiment of the present invention and the present invention is not limited to these embodiments.

Embodiment

FIG. 1 is a block diagram showing a schematic internal structure of an organic EL display device of an embodiment of the present invention. In FIG. 1, 1 is an organic EL display device, and the organic EL display device 1 of the present embodiment is a small scale type organic EL display device used in smartphones or tablets and the like. An organic EL display panel 20 of the present invention is a top emission type panel and color filter type panel which obtains a color image by passing through R, G, B color filter layers using a white light emitting layer. In the diagram, 2 is an internal or attached image processing circuit in a main control circuit of a smartphone or tablet, and the image processing circuit 2 includes an image output circuit 221. The organic EL display device 1 includes an organic EL driving circuit 10 and an organic EL display panel 20. The organic EL display panel 20 includes image lines (not shown in the diagram) and scanning lines (not shown in the diagram), and a scanning line (also called gate line) drive circuit 21 is arranged therein. The organic EL drive circuit 10 includes an interface circuit 11 which is input with image data and control signals from the image output circuit 221 of the external image processing circuit 2, a display control circuit 12 for outputting a driving signal, a scanning line control circuit 13, a frame memory 14 which stores image data input externally, an image control circuit 15, and an image signal output circuit 16. The display control circuit 12 includes an internal control signal generation circuit 121.

In normal driving mode, a control signal output from the image output circuit 221 of the external image processing circuit 2 and input via the interface circuit 11 is input to the display control circuit 12. The display control circuit 12 generates a drive signal based on the control signal and sends the drive signal to the scanning line control circuit 13 and image signal output circuit 16. The scanning line control circuit 13 controls the scanning line drive circuit 21 based on the driving signal output from the display control circuit 12. The scanning line drive circuit 21 supplies in sequence a selection voltage for writing an image voltage to each pixel to a scanning line within the organic EL display panel 20 within one frame period based on a scanning scan start signal input from the scanning line control circuit 13. Image data output from the image output circuit 221 of the external image processing circuit 2 is input to the image control circuit 15 which carries out processing of γ correction etc. The image control circuit 15 outputs image data to the image signal output circuit 16. After converting image data to an analog image voltage, the image signal output circuit 16 outputs the analog image voltage to an image line within the organic EL display panel 20 based on an image voltage timing signal input from the display control circuit 12. In this way, an image is displayed in a display region AR of the organic EL display panel 20.

On the other hand, unlike a normal driving mode, in the case of the low power consumption driving mode, it is sometimes sufficient to display only basic data such as time and date, the state of the device (signal strength, remaining battery), or communication data (call history, mail inbox). In this case, the display control circuit 12 generates a drive signal for driving the scanning line control circuit 13 and the image signal output circuit 16 using a control signal generated in the internal control signal generation circuit 121 instead of a control signal (timing signal or control command) output from the image output circuit 221 of the external image processing circuit 2 and input via the interface circuit 11, and generates a read timing signal for reading image data from the frame memory 14. In the case of a low power consumption driving mode, R (red), G (green), B (blue) image data for displaying a fixed image pattern is stored in the frame memory 14. Each image data is read using the read timing signal generated in the internal control signal generation circuit 121 of the display control circuit 12 until rewrite is performed and input to the image control circuit 16 which carries out processing of γ correction etc. The image control circuit 15 outputs the input data to the image signal output circuit 16. Here, the frame memory 14 may be small with respect to the level of definition and display gradation of the organic EL display panel 20 when in low power consumption mode, since the aim to use the frame memory 14 is to display a fixed display pattern (that is, partial display) in the organic EL display panel 20. Furthermore, although image data from all pixels of the display region (AR) is output at a refresh frequency from the image output circuit 221 of the image processing circuit 2 during normal operation, by installing the frame memory 14, it is possible to reduce to a necessary minimum the power consumption required for the output.

Figure 2:
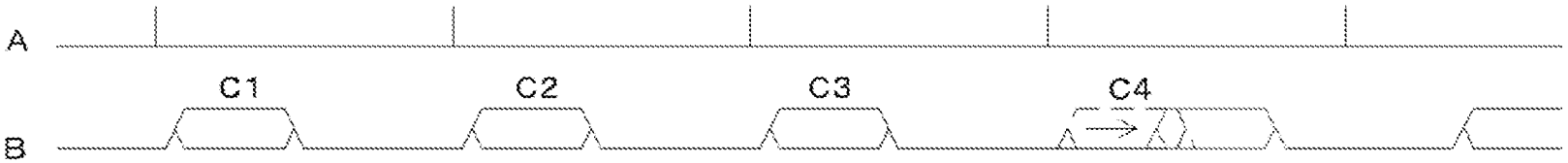
FIG. 2 is a timing flow chart for explaining read out timing of a frame memory with respect to a scanning scan start signal when driving at lower power consumption in the organic EL display device of an embodiment of the present invention.

FIG. 2 is a timing flow chart for explaining read out timing of a frame memory with respect to a scanning scan start signal when driving at lower power consumption in the organic EL display device of an embodiment of the present invention. In FIG. 2, A is a scanning scan start signal of each frame when in low power consumption drive mode, B is a read timing of the frame memory 14, and C1~C4 are read image data. As described above, in the case of the low power consumption drive mode, it is sufficient to display only basic data (fixed display pattern) such as time and date, the state of the device (signal strength, remaining battery), or communication data (call history, mail inbox), but when a fixed display pattern is displayed in the same display position, an organic EL element of this part deteriorates and a screen burn-in phenomenon occurs. Thus, in the present embodiment, as is shown in FIG. 2, when in low power consumption drive mode, a read timing of image data from the frame memory 14 is synchronized with a scanning scan start signal A of each frame and changed in predetermined cycles, for example, as in C1~C4 in FIG. 2. In this way, the display position of a fixed display pattern (display of basic data such as time and date, display of the state of the device (signal strength, remaining battery), or communication data (call history, mail inbox)) is changed and it is possible to reduce the deterioration of that organic EL element and the occurrence of the screen burn-in phenomenon.

Figure 3:
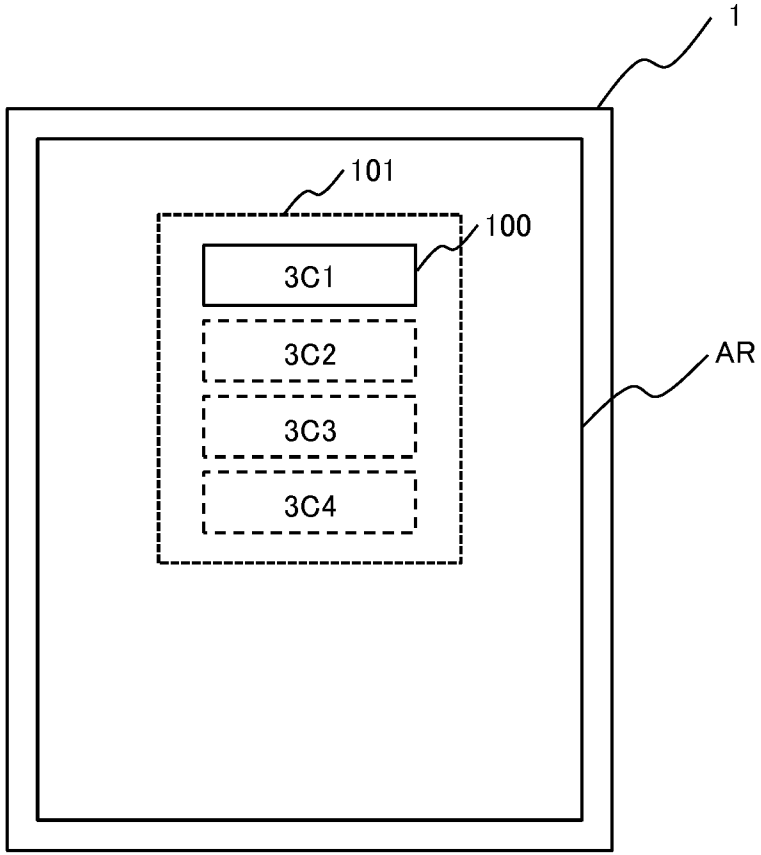
FIG. 3 is a schematic diagram for explaining one example of a display position of a fixed display pattern when driving at low power consumption in the organic EL display device of an embodiment of the present invention.
Figure 4:
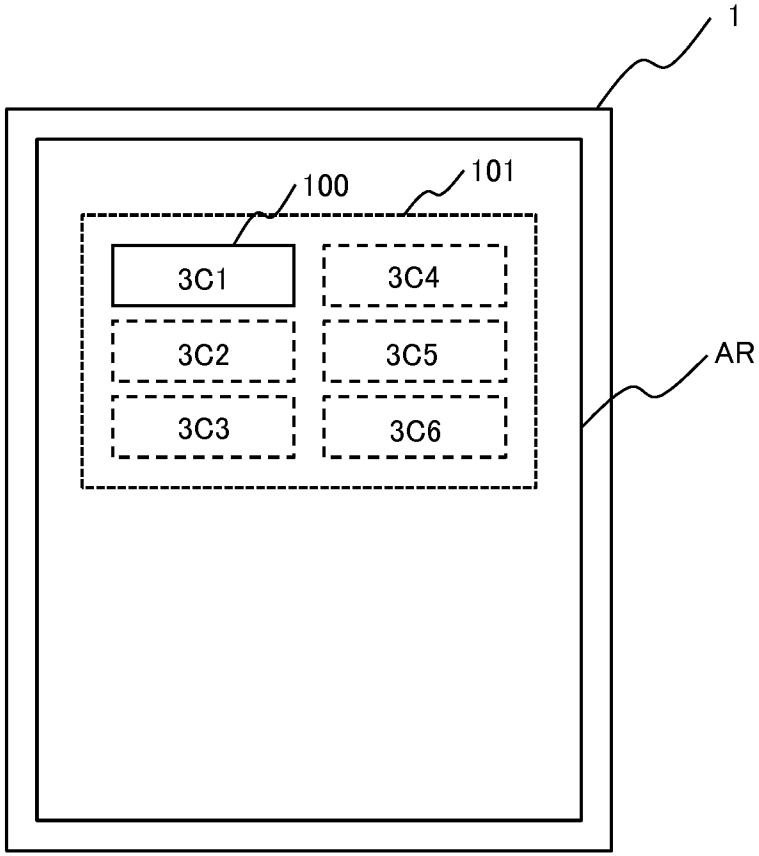
FIG. 4 is a schematic diagram for explaining another example of a display position of a fixed display pattern when driving at low power consumption in the organic EL display device of an embodiment of the present invention.

FIG. 3 and FIG. 4 are schematic diagrams for explaining a display position of a fixed display pattern when driving in a low power consumption drive mode in the organic EL display device of an embodiment of the present invention. In FIG. 3 and FIG. 4, 100 is a fixed display pattern displayed in a display region AR of the organic EL display region 20 when in low power consumption drive mode. In the example shown in FIG. 3, when in low power consumption drive mode, the display position of this fixed display pattern 100 shifts in the sequence 3C1→3C2→3C3→3C4 for each frame and then returning to the beginning, shifts in the sequence 3C1→3C2→3C3→3C4 for each frame and subsequently the same is repeated. In the example shown in FIG. 4, when in low power consumption drive mode, the display position of this fixed display pattern 100 shifts in the sequence 3C1→3C2→3C3→3C4→3C5→3C6 for each frame and then returning to the beginning, shifts in the sequence 3C1→3C2→3C3→3C4→3C5→3C6 for each frame and subsequently the same is repeated. Furthermore, the display position of the fixed display pattern 100 may also be changed to a random display position within the region 101 instead of being regularly changed as is shown in FIG. 3 and FIG. 4.

As explained above, in the present embodiment, when in low power consumption drive mode, the display position of basic data (fixed display pattern) such as time and date, display of the state of the device (signal strength, remaining battery), or communication data (call history, mail inbox) can be changed, and it is possible to reduce deterioration of that organic EL element and the occurrence of the screen burn-in phenomenon. Furthermore, by shifting an amount of basic data more than the capacity proportion of the frame memory 14 with respect to each pixel of the organic EL display panel, fixed display patterns never overlap at the time of shifting, however, performing this data shift for several pixels also has an effect on the reduction of the screen burn-in phenomenon due to the display of a fixed display pattern. In addition, when in low power consumption drive mode of the present embodiment, it is possible to realize further low power consumption by combining processes such as reduction in gradation and reduction in refresh frequency of a display. In this way, according to the organic EL display device of the present invention, in the case of the low power consumption drive mode displaying an image containing a small amount of data, it is possible to reduce both the power supplied to an organic EL display device and the power for sending an image without generating screen burn-in.

The invention carried out by the present inventors was explained in detail based on the embodiment, however, the present invention is not limited to this embodiment and various modifications are possible without departing from the scope of the invention.

What is claimed is:

1. A display device comprising:

a display panel; and a driving circuit operated in a normal drive mode and a low power consumption drive mode, the driving circuit configured to display a fixed display pattern on the display panel in the low power consumption drive mode, wherein the driving circuit includes:

an interface circuit configured to input a first image data from an external circuit;

an internal control signal generation circuit configured to generate a control signal in the low power consumption drive mode;

a memory configured to store a second image data of the fixed display pattern to be displayed on the display panel in the low power consumption drive mode;

a display control circuit configured to change a read timing of the second image data read from the memory;

an image control circuit configured to receive the first image data and the second image data, and an image signal output circuit configured to receive the first image data and the second image data from the image control circuit and to convert the first image data and the second image data to an image voltage and supply the image voltage to the display panel, wherein the first image data from the external circuit is input to the image control circuit via the interface circuit in the normal drive mode and the second image data stored in the memory is input to the image control circuit in the low power consumption drive mode, and wherein the read timing of the second image data read from the memory and a display position of the fixed display pattern to be displayed on the display panel are changed for each frame in the low power consumption drive mode.

2. The display device according to claim 1, wherein the display position of the fixed display pattern is changed in a certain sequence for each of the frames.

3. The display device according to claim 1, wherein the display position of the fixed display pattern is changed in a random sequence for each of the frames.

4. The display device according to claim 1, wherein the second image data of the fixed display pattern is read from the memory by the control signal generated by the internal control signal generation circuit until rewrite is performed.

5. The display device according to claim 1, wherein the fixed display pattern is time and date, display of a state of a device or communication data.

6. The display device according to claim 1, wherein either at least a reduction in gradation or a reduction in refresh frequency of a display is performed in the low power consumption drive mode.

* * * * *